US008313342B2

(12) United States Patent
Lin et al.

(10) Patent No.: US 8,313,342 B2
(45) Date of Patent: Nov. 20, 2012

(54) STRUCTURE OF ELECTROMAGNETIC WAVE RESISTANT CONNECTOR FOR FLEXIBLE CIRCUIT CABLE

(75) Inventors: Gwun-Jin Lin, Taoyuan County (TW); Kuo-Fu Su, Taoyuan County (TW); Chih-Heng Chuo, Taoyuan County (TW)

(73) Assignee: Advanced Flexible Circuits Co., Ltd., Taoyuan County (TW)

( * ) Notice: Subject to any disclaimer, the term of this patent is extended or adjusted under 35 U.S.C. 154(b) by 88 days.

(21) Appl. No.: 13/088,470

(22) Filed: Apr. 18, 2011

(65) Prior Publication Data

US 2012/0142218 A1 Jun. 7, 2012

(30) Foreign Application Priority Data

Dec. 3, 2010 (TW) ..... 99223569 U

(51) Int. Cl.
*H01R 12/24* (2006.01)

(52) U.S. Cl. ..... 439/492; 174/254

(58) Field of Classification Search ..... 439/67, 439/77, 492, 495, 497–499; 174/250, 254, 174/255; 361/749–751
See application file for complete search history.

(56) References Cited

U.S. PATENT DOCUMENTS

| | | | | |
|---|---|---|---|---|
| 6,345,998 | B1 * | 2/2002 | Lee | 439/260 |
| 6,743,045 | B1 * | 6/2004 | Hayashi et al. | 439/495 |
| 7,544,087 | B2 * | 6/2009 | Homer et al. | 439/492 |
| 8,083,541 | B2 * | 12/2011 | Yeh | 439/492 |
| 8,242,374 | B2 * | 8/2012 | Chuo et al. | 174/254 |

* cited by examiner

*Primary Examiner* — Thanh Tam Le
(74) *Attorney, Agent, or Firm* — Rosenberg, Klein & Lee

(57) ABSTRACT

Disclosed is a structure of electromagnetic wave resistant connector for flexible flat cable. A flexible flat cable defines an insertion device mounting section to which an insertion device is mounted. The insertion device includes a metal member that is at least partly formed of a metal material. The flexible flat cable forms thereon conductive traces on which an insulation layer is provided. The insulation layer has a surface, which forms, in at least a portion thereof, a conductive shielding layer. The conductive shielding layer extends to the insertion device mounting section, so that when the insertion device is mounted to the insertion device mounting section, electrical connection is formed between the metal member of the insertion device and the conductive shielding layer.

10 Claims, 3 Drawing Sheets

STRUCTURE OF ELECTROMAGNETIC WAVE RESISTANT CONNECTOR FOR FLEXIBLE CIRCUIT CABLE

FIELD OF THE INVENTION

The present invention relates to an insertion and connection structure for flexible flat cables, and in particular to a structure of electromagnetic wave resistant connector for flexible flat cable.

BACKGROUND OF THE INVENTION

Flexible flat cables are widely used in various electronic products, such as notebook computers, personal digital assistants, and mobile phones. A conventional flexible flat cable comprises a plurality of conductors that are each enclosed by an insulation layer and are arranged to juxtapose each other to form a flat structure. A connector or soldering is provided on the flat cable for transmission of electronic signals.

A flexible flat cable is characterized by reduced thickness and flexibility, and this often leads to improper and unstable insertion when the flexible flat cable is inserted into a mating connection slot. To overcome such a problem, it is often to add an insertion device at a leading end of the flexible flat cable to improve mechanical stability, as well as stability for electrical engagement for insertion. The insertion device is composed of a metal piece and a plastic piece.

To assemble, the metal piece is first fit over the flexible flat cable and then the plastic piece is positioned on a predetermined section of the flexible flat cable. The metal piece is slid forward to fit over and cover the plastic piece. Under this condition, the insertion section of the flexible flat cable may then be used to insert into an insertion slot.

Although this known structure of insertion device helps improving the engagement stability of the insertion device in an insertion operation, it is not constructed for protection against electromagnetic wave. It leads to an insufficiency of electromagnetic wave protection of the flexible flat cable at the section where the insertion device is mounted.

Further, although the known insertion device is adopted to overcome the problems of improper and unstable insertion, the known insertion device does not provide sufficient mechanical stability for the front end portion thereof.

SUMMARY OF THE INVENTION

Thus, an objective of the present invention is to provide a structure of electromagnetic wave resistant connector for flexible flat cable, wherein an insertion device is coupled to a flexible flat cable to ensure insertion stability and also to provide protection against electromagnetic wave.

Another objective of the present invention is to provide a structure of electromagnetic wave resistant connector for flexible flat cable, which is adjustable in thickness so as to provide insertion devices of different thicknesses for matching insertion slots of different sizes.

To achieve the above objectives, according to the present invention, a flexible flat cable forms an insertion device mounting section to which an insertion device is mounted. The insertion device comprises a metal member that is at least partly formed of a metal material. The flexible flat cable forms the conductive traces on which an insulation layer is provided. The insulation layer has a surface, which forms, in at least a portion thereof, a conductive shielding layer that is electrically connectable to a grounding path. The conductive shielding layer extends to the insertion device mounting section, so as to provide electromagnetic wave protection with the metal member of the insertion device and the conductive shielding layer when the insertion device is mounted to the insertion device mounting section, and thereby meet the needs for enhanced resistance against electromagnetic waves for electronic devices. Further, through the flexible flat cable connector structure that is thickness adjustable, the present invention can provide diverse thicknesses of insertion device to match different sizes of a corresponding insertion slot.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
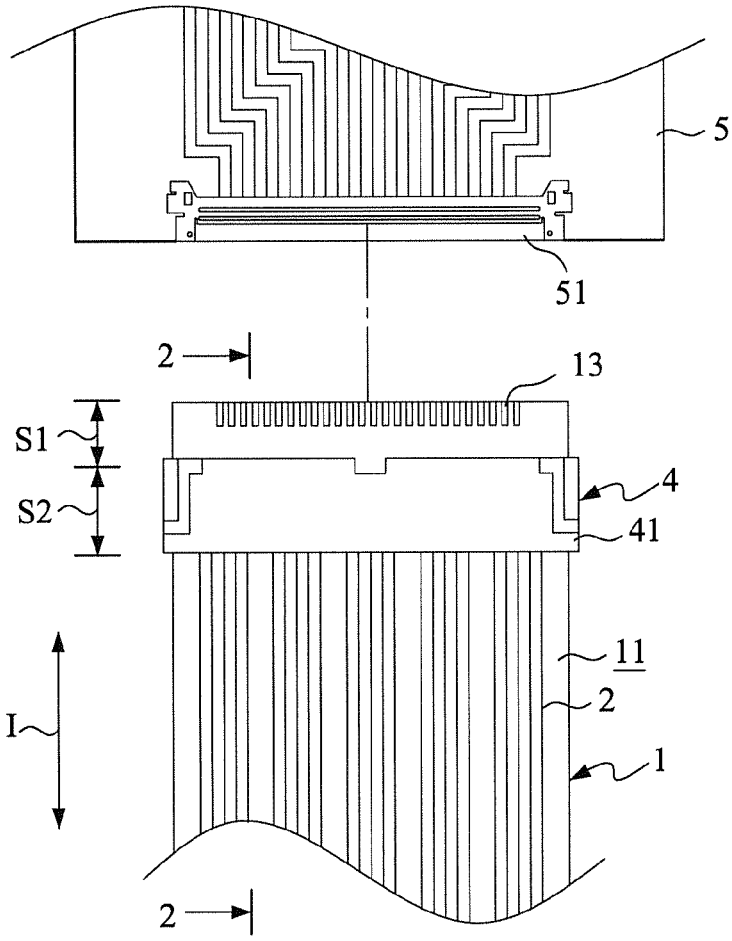
FIG. 1 is a schematic view of a first embodiment according to the present invention.
Figure 2:
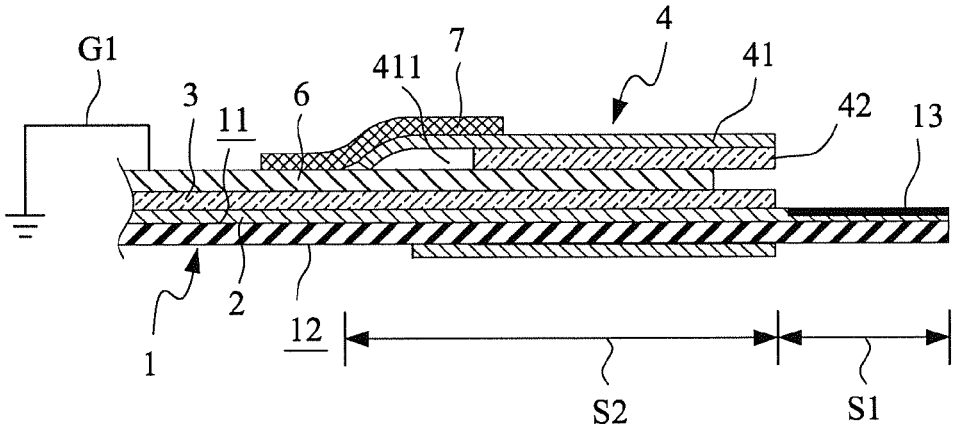
FIG. 2 is a cross-sectional view taken along line 2-2 of FIG. 1.
Figure 3:
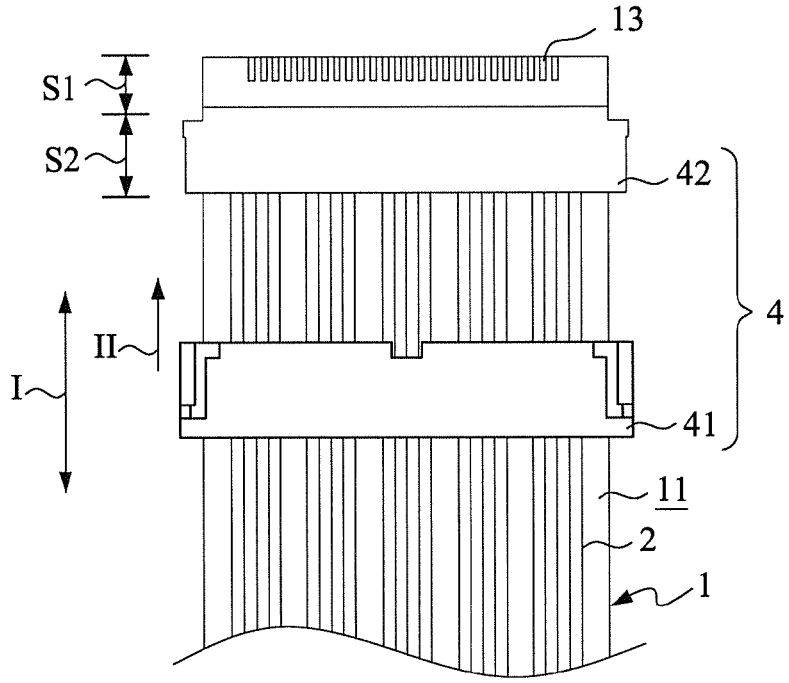
FIG. 3 is a schematic view illustrating a metal member and a plastic member positioned on a flexible flat cable according to the first embodiment of the present invention before assembled together.
Figure 4:
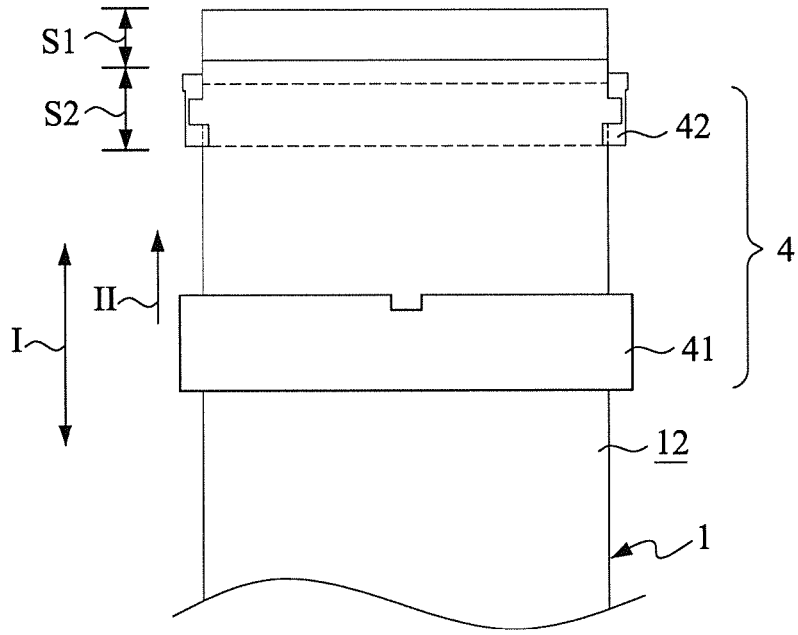
FIG. 4 is another schematic view, taken from an opposite side, illustrating the metal member and the plastic member positioned on the flexible flat cable according to the first embodiment of the present invention before assembled together.
Figure 5:
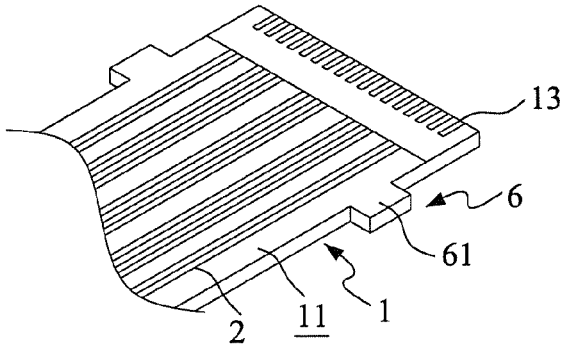
FIG. 5 is a perspective view showing the flexible flat cable according to the first embodiment of the present invention.

With reference to the drawings and in particular to FIGS. 1 and 2, which show a schematic view and a cross-sectional of a first embodiment according to the present invention, a flexible flat cable 1 has a first surface 11 and a second surface 12. The flexible flat cable 1 extends in a cable extension direction I so that the flexible flat cable 1 forms an insertion section S1 at a free end thereof and also forms an insertion device mounting section S2 in a section thereof adjacent to the insertion section S1.

The first surface 11 of the flexible flat cable 1 forms a plurality of parallel and spaced conductive traces 2. The conductive traces 2 extend through the insertion device mounting section S2 into the insertion section S1 of the flexible flat cable 1 to form a plurality of conductive contacts 13 in the insertion section S1.

An insulation layer 3 is provided on the first surface 11 of the flexible flat cable 1 and surfaces of the conductive traces 2. An insertion device 4 is positioned on the insertion device mounting section S2. The insertion device 4 is composed of a metal member 41 and a plastic member 42, wherein the metal member 41 forms a predetermined the hollow zone 411, and the plastic member 42 is of a flat plate like structure. The insertion device 4 is not limited to the structure shown in the drawings and may also be for example a metal member 41 that is formed partly with metal.

Also referring to FIGS. 3-6, to assemble, the metal member 41 of the insertion device 4 is first fit, with the hollow zone 411 thereof, through the free end of the flexible flat cable 1.

The plastic member 42 is then positioned on the first surface 11 of the flexible flat cable 1 at a location corresponding to the insertion device mounting section S2. Afterwards, the metal member 41 is pushed to slide forwards in a sliding direction II to fit over, cover, couple to the plastic member 42.

The insulation layer 3 has a surface that forms, in at least a portion thereof, a conductive shielding layer 6. The conductive shielding layer 6 can be made of for example silver paste. In an embodiment of the present invention, the conductive shielding layer 6 extends from the flexible flat cable 1 toward the free end in such a way that at least a portion of the conductive shielding layer 6 extends to the insertion device mounting section S2, whereby when the insertion device 4 is positioned on the insertion device mounting section S2, electrical connection can be formed between the metal member 41 of the insertion device 4 and the conductive shielding layer 6. The conductive shielding layer 6 is electrically connected to a first grounding path G1.

After the assembling, the flexible flat cable 1 can be inserted with the insertion section S1 thereof into an insertion slot 51 provided on a circuit board 5 so that the conductive contacts 13 of the insertion section S1 of the flexible flat cable 1 may respectively and electrically engage conductive contacts within the insertion slot 51.

Further, after the assembling of the insertion device 4 and the flexible flat cable 1, a conductive material 7 may be additionally provided on a surface of the conductive shielding layer 6 and the surface of the metal member 41 of the insertion device 4 to provide improved electrical engagement between the metal member 41 of the insertion device 4 and the conductive shielding layer 6.

Figure 6:
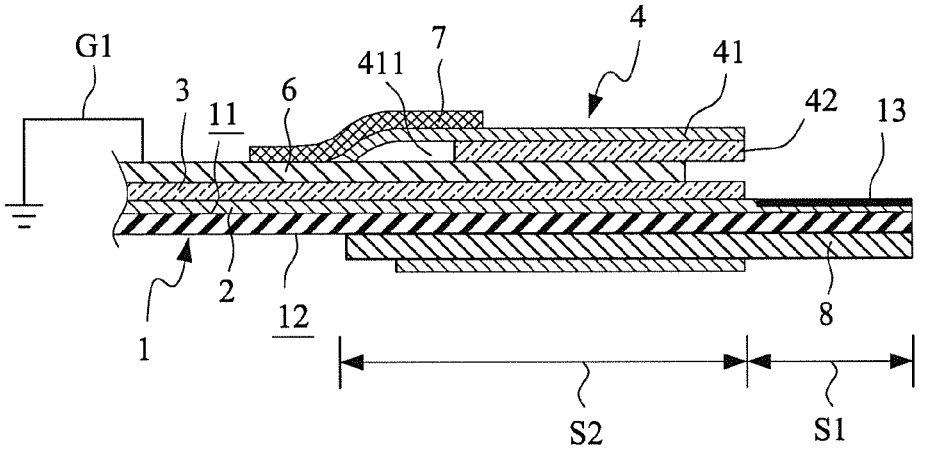
FIG. 6 is a schematic view showing a second embodiment according to the present invention.

Referring to FIG. 6, a cross-sectional view of a second embodiment according to the present invention is shown. In the instant embodiment, part/components that are similar or identical to counterparts of the previous embodiment bear the same reference for consistency and simplification. In the instant embodiment, a mechanical reinforcement layer 8 made of insulation material is provided on the second surface 12 of the flexible flat cable 1 to cover both the insertion section S1 and the insertion device mounting section S2. The mechanical reinforcement layer 8 helps improving the mechanical strengths of the insertion section S1 and the insertion device mounting section S2 of the flexible flat cable 1 to ensure stable insertion of the flexible flat cable 1 into the insertion slot 51 of the circuit board 5.

Figure 7:
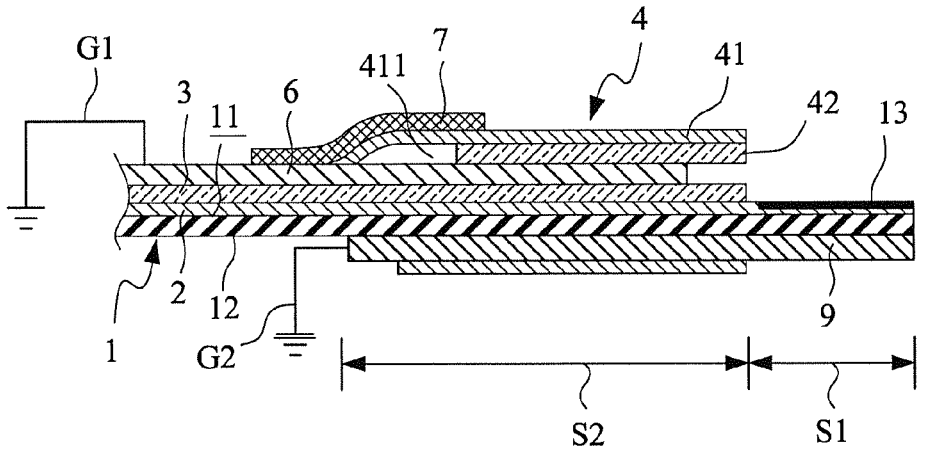
FIG. 7 is a schematic view showing a third embodiment according to the present invention.

Referring to FIG. 7, a cross-sectional view of a third embodiment according to the present invention is shown. In the instant embodiment, a shielding layer 9 made of a conductive material is provided on the second surface 12 of the flexible flat cable 1 to cover both the insertion section S1 and the insertion device mounting section S2. The shielding layer 9 is in electrical engagement with the metal member 41 of the insertion device 4 and the shielding layer 9 is electrically connectable to a second grounding path G2. The second grounding path G2 and the first grounding path G1 may be connected to each other through a via or by a conductive material extending between both surfaces to thereby form a common ground.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A structure of electromagnetic wave resistant connector for flexible flat cable, the flexible flat cable having a first surface and a second surface, the flexible flat cable extending in a cable extension direction to form an insertion section at a free end thereof and also forms an insertion device mounting section in a section thereof adjacent to the insertion section;

the first surface of the flexible flat cable forming a plurality of conductive traces, which extend through the insertion device mounting section into the insertion section of the flexible flat cable to form a plurality of conductive contacts in the insertion section;

an insulation layer formed on the first surface of the flexible flat cable and surfaces of the conductive traces;

an insertion device mounted on the insertion device mounting section, the insertion device comprising a metal member that is at least partly formed of a metal material; and characterized in that the insulation layer has a surface that forms, in at least a portion thereof, a conductive shielding layer, the conductive shielding layer extending to the insertion device mounting section, whereby when the insertion device is mounted on the insertion device mounting section, electrical connection is formed between the metal member of the insertion device and the conductive shielding layer.

2. The structure of electromagnetic wave resistant connector for flexible flat cable as claimed in claim 1, wherein the conductive shielding layer is electrically connected to a first grounding path.

3. The structure of electromagnetic wave resistant connector for flexible flat cable as claimed in claim 1, wherein the conductive shielding layer has a net-like holed structure.

4. The structure of electromagnetic wave resistant connector for flexible flat cable as claimed in claim 1, wherein the insertion device further comprises at least one plastic member, which is interposed between the metal member and the flexible flat cable.

5. The structure of electromagnetic wave resistant connector for flexible flat cable as claimed in claim 1, wherein the second surface of the flexible flat cable comprises a shielding layer made of a conductive material provided thereon and covering the insertion section and the insertion device mounting section, the shielding layer being in electrical engagement with the metal member of the insertion device.

6. The structure of electromagnetic wave resistant connector for flexible flat cable as claimed in claim 1, wherein the second surface of the flexible flat cable comprises a shielding layer made of a conductive material provided thereon, the shielding layer being in electrical engagement with the metal member of the insertion device and being electrically connected to a second grounding path.

7. The structure of electromagnetic wave resistant connector for flexible flat cable as claimed in claim 6, wherein the shielding layer has a net-like holed structure.

8. The structure of electromagnetic wave resistant connector for flexible flat cable as claimed in claim 1, wherein the second surface of the flexible flat cable comprises a mechanical reinforcement layer made of an insulation material provided thereon and covering the insertion section and the insertion device mounting section.

9. The structure of electromagnetic wave resistant connector for flexible flat cable as claimed in claim 1, wherein a conductive material is provided on a surface of the conductive shielding layer and a surface of the metal member of the insertion device.

10. The structure of electromagnetic wave resistant connector for flexible flat cable as claimed in claim 1, wherein the conductive shielding layer is electrically connected to a first grounding path; and the second surface of the flexible flat cable comprises a shielding layer provided thereon, the shielding layer being in electrical engagement with the metal member of the insertion device and being electrically connected to a second grounding path;

wherein the second grounding path and the first grounding path are electrically connected to each other through a via or by a conductive material extending between both surfaces to thereby form a common ground.

* * * * *